US005095920A

United States Patent [19]

Mattei

[11] Patent Number: 5,095,920

[45] Date of Patent: Mar. 17, 1992

[54] METHOD OF ADJUSTING AND CONTROLLING A DEVICE FOR CUTTING STRIP MATERIAL IN A MACHINE FOR THE MANUFACTURE OF COMMODITIES

[75] Inventor: Riccardo Mattei, Bologna, Italy

[73] Assignee: G. D. Societa Per Azioni, Bologna, Italy

[21] Appl. No.: 520,024

[22] Filed: May 7, 1990

[30] Foreign Application Priority Data

May 12, 1989 [IT] Italy ..... 3460 A/89

[51] Int. Cl.[5] ..... A24C 5/00

[52] U.S. Cl. ..... 131/117; 131/332; 83/15; 83/171; 83/931; 83/170

[58] Field of Search ..... 131/322, 117, 118; 83/15, 171, 931, 170

[56] References Cited

U.S. PATENT DOCUMENTS 3,186,275 6/1965 Obenshain ..... 83/170
3,822,625 7/1974 Obenshain ..... 83/342
4,426,897 1/1984 Littleton ..... 83/170

FOREIGN PATENT DOCUMENTS 2123737 1/1986 United Kingdom .

*Primary Examiner*—V. Millin
*Assistant Examiner*—Lynne A. Reichard
*Attorney, Agent, or Firm*—Cushman, Darby & Cushman

[57] ABSTRACT

In a method of adjusting and controlling a cutting device comprising two rollers counter-rotating about parallel axes and provided each with a set of blades where each blade of one roller combines with a blade of the other roller to create a scissor by which discrete pieces are cut from a continuous strip of material, heat is applied to raise the temperature of the cutting device to a selected value higher than the normal operating temperature of the machine; thereafter, having set the blades of each scissor initially by way of a system of adjusters associated with at least one of the two blades, the temperature of the cutting device during operation of the surrounding machine is maintained at a value substantially equal to the selected value by way of monitoring and control media.

1 Claim, 2 Drawing Sheets

METHOD OF ADJUSTING AND CONTROLLING A DEVICE FOR CUTTING STRIP MATERIAL IN A MACHINE FOR THE MANUFACTURE OF COMMODITIES

BACKGROUND OF THE INVENTION

The present invention relates to a method for the adjustment and control of a device serving to cut strip material in a manufacturing machine.

Whilst reference is made throughout the present specification to the field of cigarette manufacture and in particular to filter assembly machines, that is, machines by which filter tips are applied to cigarettes, no limitation of the general scope of the invention is implied by the selection of such an example.

Conventionally, the manufacture of filter tipped cigarettes involves fastening together pairs of axially aligned plain cigarettes, interconnected by a filter of double length, with a gummed band of material; once firmly stuck, the assemblies thus created are cut through half way along their length to give two single filter cigarettes each. The bands in question are severed in succession from a steadily moving continuous strip of paper material by means of a cutting device.

The prior art embraces cutting devices (disclosed in UK patent 2 123 737) comprising two rollers counter-rotating about parallel axes, each of which is fitted with a plurality of uniformly distributed blades.

Each blade of one roller pairs with a corresponding blade of the other roller to create a scissor type cutting mechanism. Thus, as the two rollers rotate, the blade of the one enters into tangential contact with a corresponding blade of the other and effects a progressive cut through the strip.

The adjustment of each pair of blades is effected manually in devices of this type, verifying that contact between the two blades, which occurs at one point transferring progressively from end to end, is maintained along the full length of the cutting edge as the rollers rotate.

It has been found, however, that in addition to an initial adjustment, further corrections need to be made to the position of the blades once the filter assembly machine is in operation.

More exactly, with the gradual rise in temperature of the machine during operation, expansion occurs in the cutting device, and more especially in the means by which the rollers are supported, of which the ultimate result is a mutual distancing of the axes of the rollers, hence part or total separation of the cutting edges of each pair of blades.

The upshot of such a contingency is that contact can fail to occur between the blade edges and the continuous strip material, and the strip therefore does not separate into discrete bands as required. On the other hand, an initial adjustment designed to take account of the effects of distancing caused by thermal expansion would lead to a destructive action on the cutting edges of the blades during the initial stages of operation.

The object of the invention is to provide a method such as will overcome those drawbacks attributable to thermal expansion which affect cutting devices of the type thus described during their operation.

SUMMARY OF THE INVENTION

The stated object is realized, according to the invention, by adoption of a method of adjusting and controlling a device for cutting strip material that comprises the steps of applying heat to raise the temperature of the cutting device to a selected value higher than the normal operating temperature of the machine, effecting an initial adjustment of the blades of the device, and then using monitoring and control expedients to maintain the temperature of the device at a steady level during operation; accordingly, throughout operation of the machine into which it is integrated, the temperature of the device can be matched to the selected value.

BRIEF DESCRIPTION OF THE DRAWINGS

The invention will now be described in detail, by way of example, with the aid of the accompanying drawings, in which.

DESCRIPTION OF THE PREFERRED EMBODIMENTS

Figure 2:
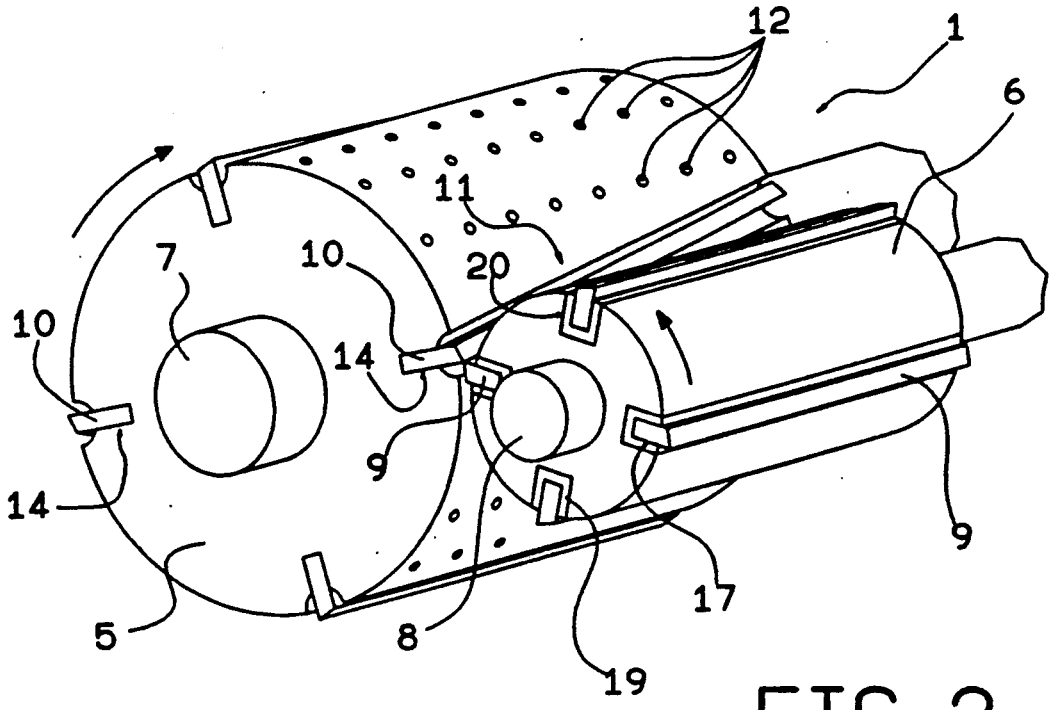
FIG. 2 is the perspective of a detail of FIG. 1.

With reference to FIGS. 2 of the drawings, 1 denotes a device for cutting filter/cigarette connecting bands, in its entirety.

Such a device 1 comprises means of support 2 which in practice are provided by part of the frame of a filter assembly machine (not illustrated).

The device 1 is designed to effect a succession of cuts through a gummed strip 3, fed in continuously by means not shown in the drawings, to the end of obtaining a plurality of discrete bands 4 each of which serves to secure together two axially aligned cigarettes (not illustrated) interconnected by a filter double the length of the filter of a single cigarette.

The device 1 comprises two substantially tangential rollers 5 and 6, mounted on respective shafts 7 and 8 disposed horizontally and parallel one with the other. The shafts 7 and 8 are mounted on the means of support 2 aforementioned and rotated in opposite directions by drive means that are not illustrated. The roller denoted 6, which rotates at a surface speed substantially matching the feed speed of the running strip 3, carries four essentially radial blades 9 distributed uniformly about its periphery with their cutting edges parallel to the axis of the relative shaft 8.

The roller denoted 5, which is greater in diameter than the first roller 6 and therefore turns at a tangential speed higher than the feed speed of the strip 3, carries four blades 10 set apart at equal angular distances, one from the next, and exhibiting cutting edges that are disposed so as to be skewed in relation to the axis of the relative shaft 7.

The rollers 5 and 6 are proportioned and positioned about their respective axes in such a way that the blades 10 and 9 meet in succession, always in the same pairings, at a location which may be referred to as the cutting station 11.

By reason of their mutual angle and the difference in their tangential speeds, initial contact between a pair of blades 9, 10 occurs at one end only, on reaching the cutting station 11; thereafter, as the rollers 6 and 5 continue rotating, the blades 9, 10 cross over and ride against one another until their ultimate separation at the opposite end.

The strip 3 is fed continuously between the two rollers 5 and 6, and held against the cylindrical surface of the larger roller 5 by conventional suction means of which only the surface holes 12 are illustrated (FIG. 2).

Each time a pair of blades 10 and 9 comes together at the cutting station 11, a band 4 of given length is severed progressively from the continuous strip of material 3 in a smoothly executed point-by-point scissor-type cut.

The discrete band 4 thus obtained is distanced from the end of the continuous strip 3 by reason of the higher speed of the larger roller 5, and held to its surface by the suction means 12 until arrival at a further work station illustrated schematically as a roller 13.

Figure 3:
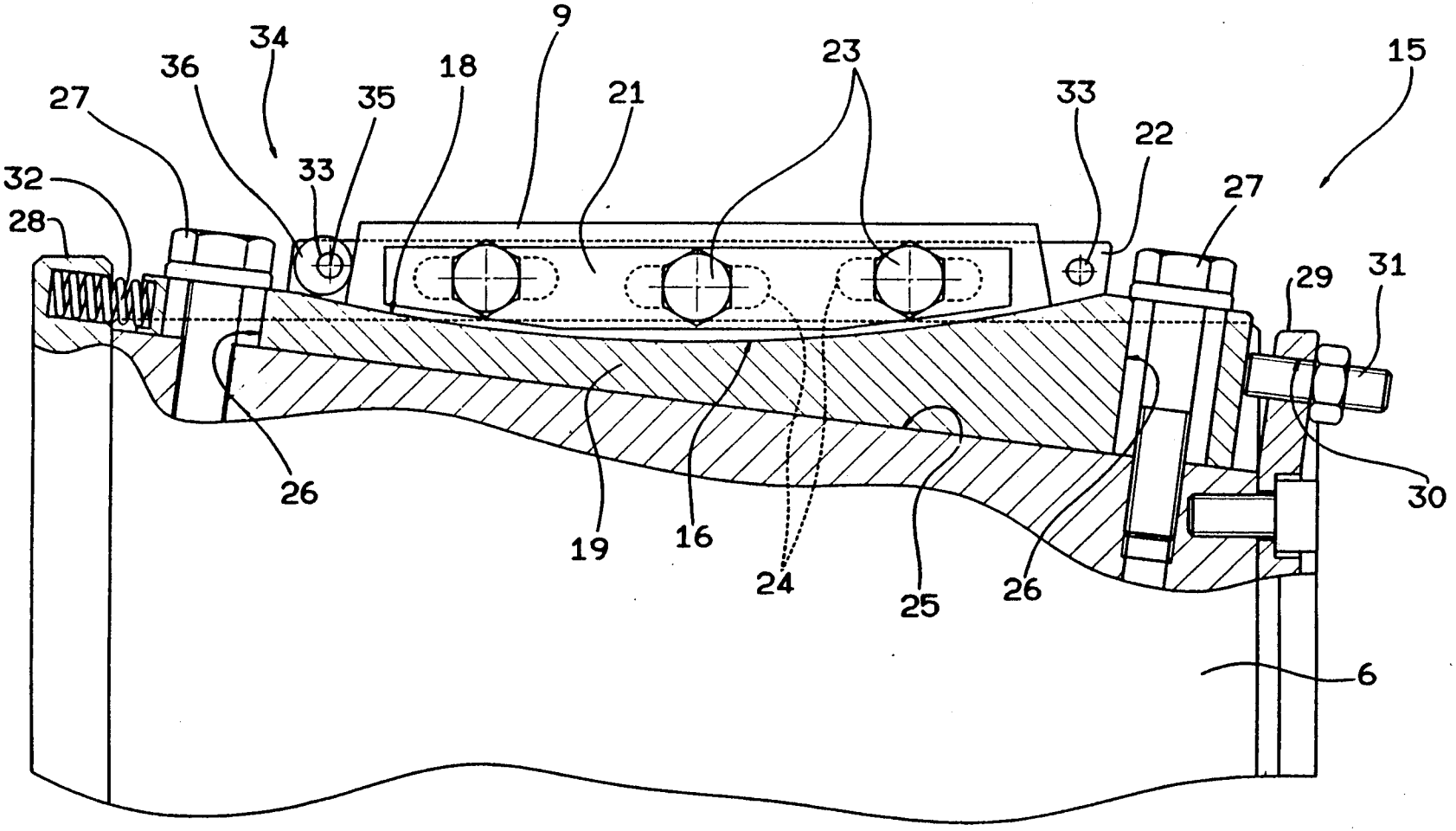
FIG. 3 is a cutaway showing a detail of FIG. 1.

Whilst the skew blades 10 are mounted fixedly in respective sockets 14 of the relative roller 5, the matching blades 9 are mounted to their roller 6 by way of adjustment means which are denoted 15 in their entirety and will now be described in detail with reference to FIG. 3.

16 denotes the longitudinal edge of the blade 9 opposite to the cutting edge, which exhibits a bowed profile and occupies a socket 17 of which the bottom, denoted 18, is fashioned as a cradle so as to accommodate the bowed edge 16. More exactly, the socket 17 is fashioned in a bar 19 accommodated by an axial channel 20 afforded by the roller 6.

The side walls of the socket 17, which breast with the two faces of the blade 9, consist in respective plates 21 and 22 rigidly associated with the bar 19 and connected one with the other by bolts 23 that pass through slots 24 in the blade 9.

The bottom of the single channel 20, denoted 25, which accommodates the side of the bar 19 opposite to the side affording the socket 17, is angled in relation to the axis of the roller 6.

The bar 19 is provided at its longitudinal ends with clearance slots 26 through which bolts 27 are inserted and screwed into the roller 6.

28 and 29 denote two disks disposed coaxial with the roller 6 and rigidly attached thereto at either end.

The right hand disk 29 (as viewed in FIG. 3) affords a plurality of threaded holes 30, corresponding one to each channel 20, passing through from side to side and disposed parallel to the longitudinal axis of the angled bottom 25 of the channel.

Each hole 30 is occupied by a screw 31 of which the end directed in toward the roller 6 registers with one end of the bar 19. The remaining end of the bar engages with a coil tension spring 32 accommodated in a cylindrical seating in the left hand disk 28. The two longitudinal ends of the plate denoted 22 extend beyond the longitudinal ends of the blade 9 and are provided with respective clearance holes 33 engaged by an adjustment mechanism 34 (of which the purpose will become clear in due course) comprising a pin 35 and a cam disk 36.

Figure 1:
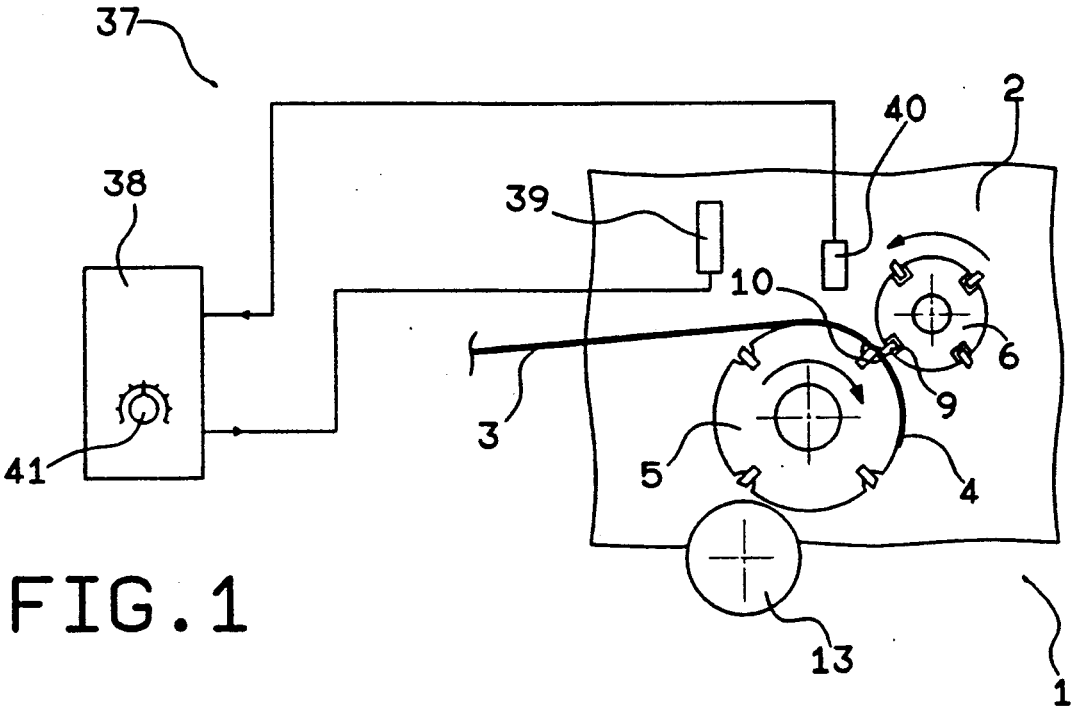
FIG. 1 illustrates a device by means of which to implement the method according to the present invention, viewed partly in frontal elevation and part block diagram.

Referring now to the block diagram part of FIG. 1, 37 denotes means of monitoring and controlling the temperature of the cutting device 1, considered in their entirety.

The means 37 in question comprise a thermostat 38, heating means 39 located in the means of support 2 and interlocked to the thermostat 38, and means 40 by which to sense the temperature of the means of support 2 and relay a relative output signal to the thermostat. The thermostat 38 is provided with a knob 41 by means of which to select a predetermined temperature at the cutting device 1.

Supposing the operating temperature of the filter assembly machine were to be 40° C., then before the machine is started up, the knob 41 will be set by the operator to a higher temperature, say 50° C. Once a given period of time has elapsed, and the temperature of the means of support 2 and of the entire cutting device 1 has been raised by the heating means 39 and stabilized at the prescribed value, the operation of setting each of the pairs of blades 9, 10 of the cutting device can proceed.

The operation is conducted in two stages.

First, the bolts 27 securing the bar 19 to the roller 6 are slackened off to enable adjustment of the screw 31 by means of an appropriate tool.

Rotation of the screw 31 in its hole 30 causes the bar 19 to slide back or forth along the angled bottom 25 of the channel 20, thereby shifting the blade 9 radially with respect to the roller. Once contact has been established between the adjustable blade 9 and the corresponding blade 10 of the other roller 5, the second stage of the operation can commence, namely, adjustment of the angle at which the blade 9 is set.

This is achieved by slackening the blade bolts 23 and causing the blade 9 to slide over the cradled bottom 18 of the seating 17. The sliding movement is permitted by the presence of the slots 24, and produced by rotation of the adjustment means 34 about the pin 35 mounted in a respective hole 33 in the plate 22 through a given angle such as causes the cam disk 36 to interact with the end of the blade 9. The adjustment is successful when, on rotating the rollers 5 and 6, contact is maintained between the cutting edges of the two blades 9, 10 along their entire respective lengths.

With the bolts 27 and 23 retightened, the filter assembly machine is ready to operate.

During operation, parts in movement act as a source of heat, and the temperature of the filter assembly machine therefore rises gradually from ambient to a determined running temperature.

The cutting device 1 is not subject to a variation in temperature of this nature, however, held as it is by the thermostat 38 at a rigorously constant temperature higher than the operating temperature of the machine, through regulation of the amount of heat emitted by the heating means 39 in response to the feedback signal from the sensing means 40.

It will be noted that the means 37 by which the temperature of the cutting device 1 is monitored and controlled should remain in operation, even during interruptions in the operation of the filter assembly machine, in order to permit starting up the machine at any given moment without the risk of malfunction and without any need for further adjustment of the blades.

What is claimed is:

1. A method for transversally cutting an indeterminate-length supply of strip material into a series of discrete longitudinally successive bands, comprising:

providing two counter-rotating rollers having generally tangentially related radially outer peripheral surfaces, one having securely mounted therein each of a plurality of equiangulariy spaced, skewingly longitudinally extending, radially outwardly projecting first cutting blades, and the other having radially and longitudinally rockably adjustably mounted therein each of a plurality of equiangularly spaced, skewingly longitudinally extending, radially outwardly projecting second cutting blades, and a thermostatically controlled heater for heating the rollers to and maintaining said rollers at predetermined, above-ambient temperature;

using said thermostatically controlled heater for heating the rollers to a predetermined, above-ambient temperature and, while maintaining said temperature, counter-rotating said rollers about parallel longitudinal axes thereof and adjusting said second cutting blades both radially and longitudinally rockably with regard to said other roller, until respective ones of said second cutting blades accurately combine with respective ones of said first cutting blades to provide a scissors-like cutting action which extends longitudinally of said rollers throughout a width of path which is wider than said strip material; and feeding said strip material along a path between said rollers perpendicular to said longitudinal axes while continuing to use said heater for maintaining said rollers as said predetermined temperature and thereby cutting successive leading end increments of said supply of strip material into a series of discrete longitudinally successive bands.

* * * * *